United States Patent [19]

Müller

[11] 4,007,588

[45] Feb. 15, 1977

[54] IDLING AND PART-LOAD CONTROL OF IGNITION DISTRIBUTOR RESPONSIVE TO PRESSURE UPSTREAM OR DOWNSTREAM OF THROTTLE VALVE

[75] Inventor: Klaus Müller, Seevetal, Germany

[73] Assignee: Exxon Research and Engineering Company, Linden, N.J.

[22] Filed: May 20, 1974

[21] Appl. No.: 471,598

[30] Foreign Application Priority Data

May 22, 1973 Germany ..... 2325807

[52] U.S. Cl. ..... 60/274; 123/117 A

[51] Int. Cl.[2] ..... F01N 3/00; F02P 5/04

[58] Field of Search ..... 60/274, 285; 123/117 A

[56] References Cited

UNITED STATES PATENTS

| | | | |
|---|---|---|---|
| 1,288,736 | 12/1918 | Stone | 123/117 A |
| 3,272,191 | 9/1966 | Walker | 123/117 A |
| 3,457,905 | 7/1969 | Jukes | 123/117 A |
| 3,478,729 | 11/1969 | Tada | 123/117 A |
| 3,479,998 | 11/1969 | Walker | 123/117 A |
| 3,503,376 | 3/1970 | Walker | 123/117 A |
| 3,650,253 | 3/1972 | Cooksey | 123/117 A |
| 3,791,144 | 2/1974 | Lang | 60/278 |
| 3,793,833 | 2/1974 | van Basshuysen | 60/285 X |

*Primary Examiner*—Carlton R. Croyle
*Assistant Examiner*—Thomas I. Ross
*Attorney, Agent, or Firm*—Joseph J. Dvorak

[57] ABSTRACT

The pollution content, for example, CO and $NO_x$, of exhaust gas from spark ignition engines is decreased by a reactor and also by retarding ignition spark (a) during engine-idling solely as a function of pressure downstream of throttle valve and (b) during engine part-load solely as a function of pressure upstream of . At engine full-load only the normal spark timing of the engine operates. In this way the minimum effective exhaust gas reactor temperature is quickly reached and maintained during idling and part-load, but the reactor is not overheated when engine is at full-load.

5 Claims, 6 Drawing Figures

Figure 1:
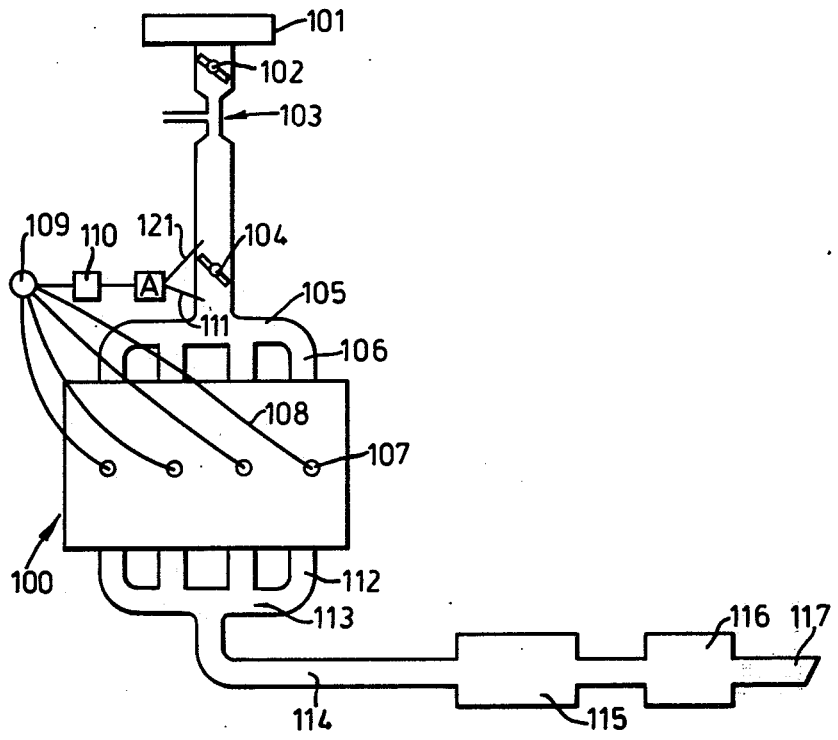

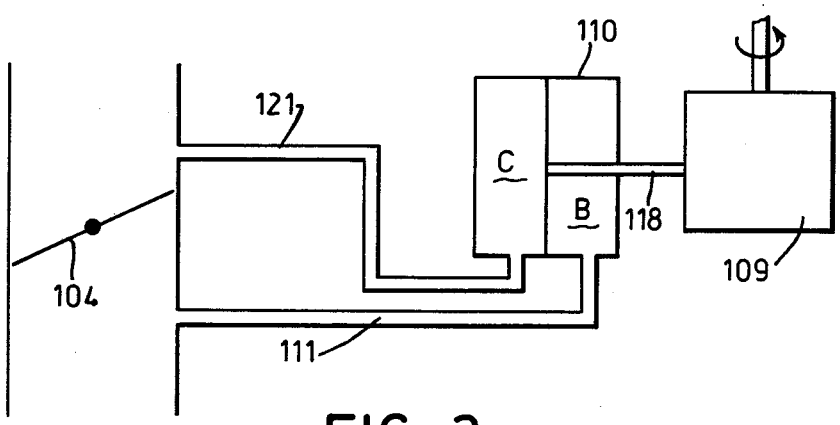
FIG. 2. PRIOR ART
FIG. 3.
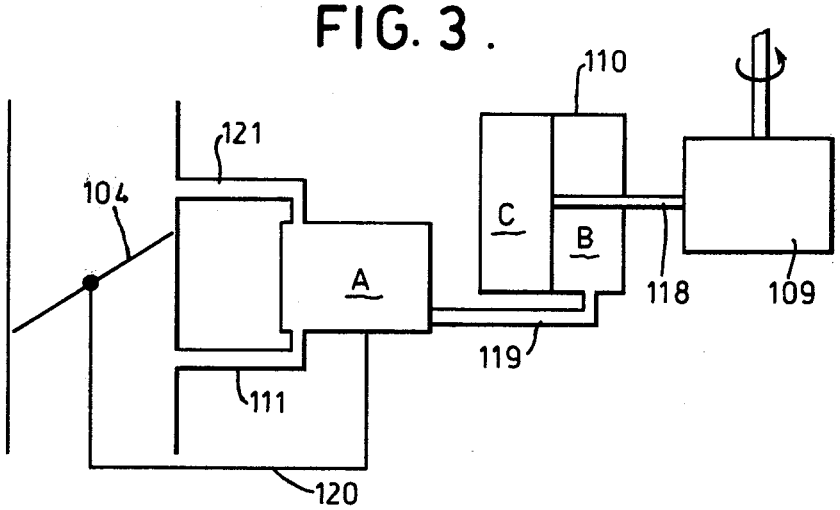

IDLING AND PART-LOAD CONTROL OF IGNITION DISTRIBUTOR RESPONSIVE TO PRESSURE UPSTREAM OR DOWNSTREAM OF THROTTLE VALVE

The present invention relates to adjusting the ignition timing of spark ignition engines and to a method and a system for reducing atmospheric pollution from the exhaust gases of motor vehicles provided with exhaust gas purifying reactors, such as catalytic and thermal reactors. More particularly, the invention proposes for the said purpose, a method and system whose operation regulates the delay in ignition advance in particular phases of operation of the engine as described below.

Legislation which is proposed or in force relating to atmospheric pollution sets definite limits on the content of polluting substances in the exhaust gases of motor vehicles. To meet these limits the exhaust systems of motor vehicles must be equipped with devices that effect the purification of the exhaust gases. The current laws (1973) in some European countries set definite limits only on the content of hydrocarbons and carbon monoxide in the exhaust gas. For nitrogen oxides, $NO_x$, e.g. nitric oxide provision is being made to introduce regulations on the maximum amounts of $NO_x$ emission, such as those regulations in force in the United States of America.

The best known principle of solution for the transformation of motor vehicle exhaust gases resides in the thermal and catalytic recombustion of the exhaust gases. In "Motortechnische Zeitschrift" 33 (1972), pages 206 to 213, in a comparative survey of the state of development of thermal and catalytic combustion in petrol engines, this is referred to by a description of different thermal and catalytic reactors.

A particularly effective reaction unit for reducing the impurities in exhaust gases by thermal after-burning is described in German Offenlegungsschrift No. 2,138,302. Such a unit can also have a further unit of the type described in German Offenlegungsschrift No. 2,332,113.

The proper working of a thermal or catalytic oxidizing reactor is ensured only when an adequately high temperature is attained and maintained. The time taken for such a temperature to be established in the reactor is a function of the ignition advance, in practice, since the temperature in the combustion chamber of the engine can vary over a relatively wide range when the ignition timing is varied. To be more precise, a delay in the ignition time causes an increase in the temperature in the reactor, since under these conditions the reaction of combustion of the air and fuel mixture tends to be incomplete in the combustion chamber, whereby the temperature of the exhaust gas passing to the reactor is substantially higher.

The ignition advance is one of the characteristics that is prearranged in a motor vehicle by the makers and therefore in mass-produced motor vehicles there is no provision for ignition lag at the desired moment during the engine operating cycle which is suitable for establishing the rapid starting of the combustion reaction of CO and HC in the reactor, and this constitutes a considerable drawback from the point of view of obtaining a balanced and speedy purification of the exhaust gases from these components.

It should, moreover, be noted that by introducing this lag the performance of the engine is impaired, and that although a ignition lag is useful for rapidly attaining the temperature of self-sustaining reaction in the reactor, it is extremely detrimental if maintained when the engine has reached its working temperature, i.e. when the ignition time predetermined by the maker has to be used and for the better operation of the engine.

Normally, the ignition adjustment is achieved as a function of the speed, for example by means of centrifugal force, and by additional spark control as a function of the vacuum at the throttle valve by means of a diaphragm box or a double box. In this case the vacuum below the throttle valve during idling is transmitted into a chamber of a two-chamber diaphragm box or into one box of a "double box" (vide Bosch "Technische Berichte 3", No. 1, November 1969, pages 8–19). Through a mechanical connection between the diaphragm and the ignition distributor the ignition is adjusted to "retard". Simultaneously, the vacuum above the throttle valve acts on the other chamber of the two-chamber diaphragm box or on the other box of the double box, respectively, this counteracting the vacuum below the throttle valve in the other chamber or box. At part load the ignition time is substantially shifted towards "advance" since, due to corresponding construction of these ignition timing systems, the vacuum above the throttle valve acts on the other chamber or other box, respectively, so that the spark advance predominates. At full throttle the ignition adjustment is controlled practically exclusively as a function of speed, for example by means of centrifugal force.

It has been found with automotive engines, especially those having medium or relatively small cylinder capacities, provided with a thermal reactor for after-burning, that the use of the above-described ignition timing devices is insufficient. The ignition is not altered sufficiently during idling and part load to achieve a temperature in the thermal reactor high enough for detoxification of the exhaust gases. Furthermore, at idling and part loading the necessary minimum temperature for after-burning is either not achieved at all or is only reached after a substantial period of running, whereby the reactor is wholly or partially ineffective.

It is an object of the present invention to provide a method and a system for adjusting the ignition advance and retard of a spark-ignition engine fitted with an exhaust gas converter, by means of which (a) the temperature in the exhaust gas converter is increased rapidly during idling and part load to the temperatures required for the conversion of the exhaust gases and is maintained there: (b) at full throttle ignition adjustment known per se is carried out as a function of the speed, for example by means of centrifugal force.

According to one feature of the invention there is provided a method of adjusting the ignition timing of spark ignition automotive engines, provided with an exhaust gas reactor device, during idling and part load in which the adjustment is made as a function of the pressure conditions obtaining at the throttle valve; wherein the adjustment is effective (a) during idling solely as a function of the pressure downstream of the throttle valve and (b) during part load solely as a function of a pressure upstream of the throttle valve.

Preferably the ignition timing adjustment is effected pneumatically and it is preferred that the normal ignition timing of the engine be restored in accordance with a signal which is representative or indicative of reaching a predetermined mininum loading of the engine. This signal can be derived, for example, from increasing engine speed beyond a predetermined value; or from moving the throttle plate (or throttle controls such as the accelerator pedal) beyond a predetermined position.

In accordance with another feature, the invention provides a system for the ignition adjustment of a spark-ignition engine provided with an exhaust gas reactor device, which system comprises (a) first means for retarding the ignition timing during idling from the normal timing, said first means being operative in response solely to the pressure obtaining downstream of the throttle valve when the engine is idling, (b) second means for retarding the ignition timing (but to a lesser extent than in (a)) during part loading of the engine from the normal timing, said second means being operative in response solely to the pressure obtaining upstream of the throttle valve when the engine is under part load.

Preferably, said first and second means comprises a pressure-transference conduit communicating at one end with a pressure-response member which is movable in accordance with the differential pressure across that member, and adapted so as to communicate at the other end with the intake system of the engine (i) solely downstream of the throttle valve when, during operation, the engine is idling, (ii) solely upstream of the throttle valve when, during operation, the engine is under part load; and, in both cases, said pressure-responsive member being connected to the ignition distributor of the engine to restrain said distributor in a spark retard position which decreases as, during operation, engine speed develops from idling through part load.

Advantageously the pressure-responsive member is an elastically deformable member and is very suitably a two-chambered diaphragm-containing box; in which case said conduit communicates with one chamber only of said box. Advantageously said other end of the conduit is bifurcated, whereby the forks communicate with the engine intake system respectively upstream and downstream of the throttle valve.

Conveniently the conduit is adapted for the said communication only upstream or only downstream of the throttle valve by a switching device controllable by the position of the throttle valve. The switching device may be, for example, a solenoid, the switching position of which is controlled electromagnetically by the position of the throttle valve. Alternatively the switching of the conduit into communication as aforesaid may be effected by a purely mechanical means, such as a valve member rotatable by the axle of the throttle valve.

The invention brings about the result that the ignition, through the sole action of the vacuum downstream of the throttle valve on the chamber of the diaphragm box, and therefore on the ignition distributor, is substantially retarded from normal timing because the vacuum above the throttle valve, through appropriate switching of the solenoid, does not act simultaneously on the diaphragm. Hence a particularly pronounced ignition retarding during idling is obtained, enabling the temperature in the connected waste gas converter to be raised particularly rapidly to a high value.

In the case of partial load, the invention enables the ignition still to be considerably retarded, since the new setting of the throttle valve actuates the solenoid valve to switch over so as to establish communication solely between the diaphragm chamber and the zone upstream of the throttle valve whereby, through the action of a lesser vacuum retarded ignition is obtained, albeit not so the same extent as during idling. On further accelerating, the ignition adjustment through centrifugal force takes precedence and establishes the advanced ignition which is needed for full load. In this way the ignition delay in idling and with partial load is cancelled out; this prevents the exhaust gas converter from becoming overheated and material damage from occurring.

The invention is particularly useful for automotive systems having exhaust gas purification systems of the thermal type. It will be appreciated that the invention can also be applied to systems in which, additionally or alternatively, provision is made for recycling some of the exhaust gas back to the engine. Several such systems have been proposed, one being as described in British specification 1,314,859.

Figure 4:
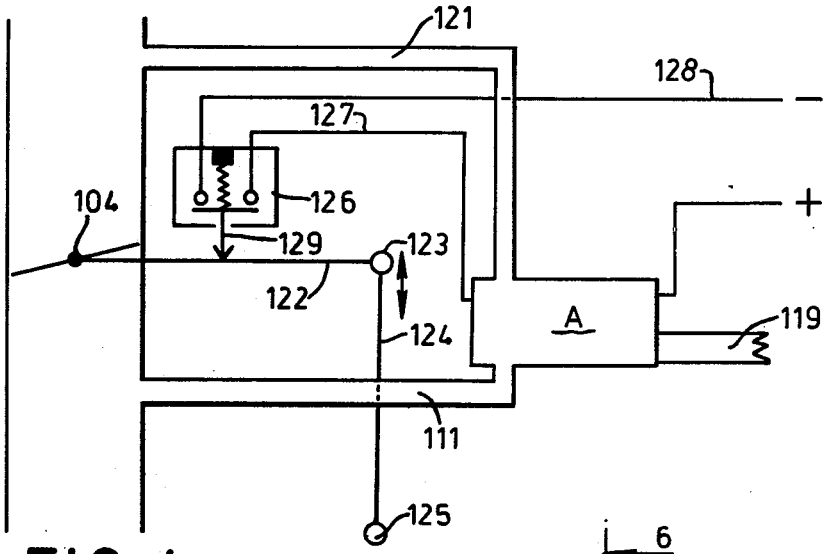
Figure 5:
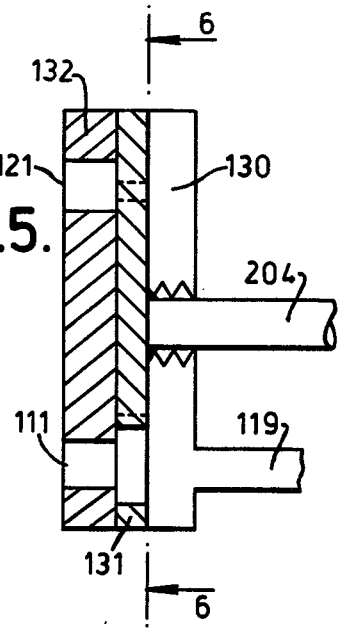
Figure 6:
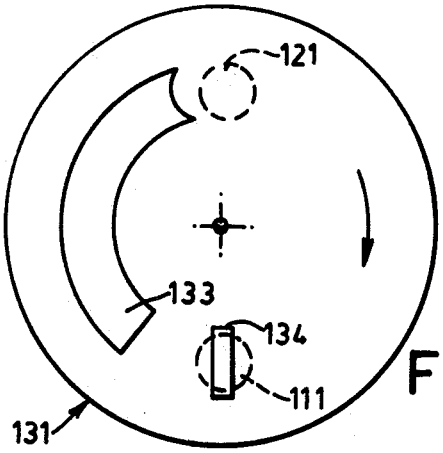

The invention will now be described, by way of example only, reference being made to the drawings in which:

FIG. 1 is a schematic representation of an engine embodying one system in accordance with the invention, FIG. 2 is a diagrammatic representation of a known ignition adjustment system, FIG. 3 is a diagrammatic representation of an ignition adjustment system in accordance with the invention, FIG. 4 is a diagrammatic representation of one specific mode of operating the system shown in FIG. 3, FIG. 5 is a part-sectional view, and FIG. 6 is a view of 6—6 of FIG. 5, of a purely mechanical construction of part of the system shown in FIG. 3.

Referring to FIG. 1, the engine is indicated by reference 100. Air is induced through air cleaner 101 and passes the choke plate 102 to the carburetor 103 whereat fuel is admixed from a fuel supply pipe.

The air-fuel mixture passes to an intake manifold 105 at a rate determined by the setting of throttle plate 104 and is distributed to each cylinder of the engine through a respective intake pipe 106. The air-fuel mixture is ignited in the cylinder by an electric spark at a spark plug 107, the electrical pulse for this being supplied along conductor 108 from a distributor 109. The distributor 109 is of the type well known in the art and which advances the spark timing as the engine speed rises. The spark advance according to speed is modified as will be explained hereafter, by relaying to a pressure capsule 110 the pressure either downstream of the throttle plate 104 by means of a line 111 or upstream of it by means of line 121. The pressure capsule comprises a deformable diaphragm (not shown) which is connected by a link to the distributor 109.

Exhaust gas is discharged via a pipe 112 to an exhaust manifold 113 connected to an exhaust pipe 114. The downstream end of the exhaust pipe 114 is connected into an exhaust gas purifying reactor 115, and exhaust gas passes from the latter to a silencer 116 and thence via a tail pipe 117 to atmosphere.

By means of a well known form of ignition timing device according to FIG. 2 the ignition is controlled by two factors, viz. by the pressure conditions below and above the throttle valve 104 in the carburettor and by the rotational speed by means of centrifugal force regulation in the distributor 109. The vacuum diaphragm box 110 consists of two chambers B and C which are separated from one another by a diaphragm. The diaphragm is connected mechanically (indicated by 118) with the ignition distributor 109. When there is vacuum in chamber B relative to chamber C the ignition in the ignition distributor is set by means of link 118 toward retard. If there is vacuum in chamber C relative to chamber B then there takes place in a similar way an adjustment of the ignition towards advance. The chambers B and C of the diaphragm box are joined as shown in FIG. 2 via entirely separate conduits with apertures in the carburettor upstream and downstream of the throttle valve. By means of this arrangement a force proportional to the pressure difference above and below the throttle valve acts via the diaphragm and the mechanical connection 118 on the ignition mechanism, whereby ignition timing adjustment is brought about. In this way the following spark settings are obtainable:

During Idling: spark retard by vacuum in chamber B relative to chamber C.

During part load: by vacuum in chamber C relative to chamber B advanced timing of ignition, which is supported simultaneously by the commencement of advance timing through centrifugal force in the ignition distributor.

With full load: ignition timing is controlled practically solely by the speed of rotation via the centrifugal force in the ignition distributor.

In the case of vacuum box or capsule with two systems, the so-called double box, the two chambers B and C are arranged separately. By means of suitable design, however, they act jointly on a device for controlling the spark timing corresponding to the mechanical connection 118. Here, spark advance receives priority, i.e. even with simultaneous occurrence of a vacuum at the "retard box" and the "advance box" the correct part load adjustment toward advance is obtained (Bosch "Technische Berichte" 3, No. 1, November 1969, page 19, column 1 lines 27 to 30). This separation of the two chambers B and C in separate boxes does not alter in principle the method of operation of the ignition adjustment device according to FIG. 2.

In the embodiment according to the invention illustrated in FIG. 3, the influence of the difference in the pressures above and below the throttle valve 104 (via the mechanical connection 118) on the ignition distribution 109 is entirely ruled out. Thus there is no additive or subtractive effect of the negative pressures on the diaphragm as in the case of the device shown in FIG. 2. This is affected by a solenoid valve A (also indicated in FIG. 1), which connects line 121 either with the aperture upstream of the throttle valve 104, or the line 111 downstream of the throttle valve, with the chamber B of the diaphragm box 110 by common line 119. The diaphragm box 110 is thus connected by one chamber only (chamber B according to FIG. 3) via the solenoid valve with either the zone upstream or the zone downstream of the throttle valve. Thus, in contrast to the known device shown in FIG. 2 spark advance by the pressure conditions in the carburettor is neither provided for nor possible.

The solenoid valve A is operated by the throttle valve 104 by any suitable mechanism. This mechanism is diagrammatically shown in FIG. 3 at 120. Naturally it is not necessary for the mechanism to lie to any extent in the intake zone.

One convenient means of operating solenoid A from throttle valve 104 is illustrated diagrammatically in FIG. 4 of the drawings. The axle of throttle plate 104 is connected by linkage 122–124 with accelerator pedal 125. A fixed microswitch 126 is arranged so that in the idling position of the engine an electrical circuit 127, 128 involving solenoid A is made by spring-urged contact 129. Depression of the pedal 125 (corresponding to part-load of the engine) causes a shift in position of linkage 122–124 away from the fixed microswitch 126. The contact 129 is thus spring-urged away to follow the linkage and the electrical circuit involving solenoid A is broken.

The solenoid valve A is thus regulated by the setting of the throttle valve in such a way that during idling the vacuum downstream of the throttle valve (via the chamber B and the mechanical connection 118) sets the ignition towards retard. In the case of partial load, because of the altered position of the throttle valve 104 the solenoid valve A is switched in such a way that vacuum upstream of throttle valve 104 actuates (via the chamber B and the mechanical connection 118) the ignition mechanism towards retard. The ignition positions are accordingly as follows:

During idling: Spark retard by vacuum downstream of the throttle valve 104 and in the chamber B; the vacuum effective during idling is solely the vacuum downstream of the throttle valve.

With partial load: by switching of the solenoid through the setting of the throttle valve at part load, the vacuum upstream of the throttle valve, actuates (via the chamber B and the mechanical connection 118) the ignition distributor towards retard.

By means of a corresponding position of the drilling, which depends on appropriate position of the apertures by which lines 121 and 111 communicate with the upstream and downstream throttle zones (and this positioning will depend on the respective model of the carburettor), ignition takes place at a rather earlier time at the part load than during idling, although a pronounced spark retard predominates in spite of the centrifugal force adjustment acting in the opposite direction.

With full throttle: in this case, as in the known ignition adjustment device of FIG. 2, the centrifugal force control depending on the speed predominates. Atmospheric pressure obtains at the throttle valve and so spark advance is controlled by distributor 109.

FIGS. 5 and 6 illustrate an alternative, purely mechanical, mode of operating diaphragm box 110. The axle 204 of throttle plate 104 enters a pressure-tight chamber 130 from which line 119 exists to diaphragm box 110 as aforedescribed. The axle is secured within chamber 130 to a valve plate 131 (FIG. 6). The valve plate is spring-urged into connection with plate 132 which is secured to the carburettor casing and has apertures 111 and 121 to correspond with bores 111 and 121 in that casing.

Plate 131 is slotted as shown at 133 and 134. The slots are located and arranged so that apertures 111 or 121 can only be opened separately. It is clear, therefore that only 111 and 119, or 121 and 119, can be switched into connection to operate the diaphragm box. It will be appreciated that there could be, according to the precise location of the slots 133 and 134, a very short period (seconds only) when both lines 111 and 121 are disconnected.

This type of mechanical valve has the advantage that it can be securely affixed and, because of working under varying degrees of vacuum, is to a large extent self-tightening.

EXAMPLE 1

Comparative tests were carried out in which a mass-produced VW 411 engine was equipped with a thermal reactor according to German Offenlegungsschrift No. 2,138,302. One series of tests employed the ignition setting device according to the mass-produced design. Another series employed a vacuum ignition timing device according to the invention. As control (comparison), there were measured the reactor temperatures as a function of the running time and the carbon monoxide emission and emission of unburnt hydrocarbons per test according to the test method: "Examination of the Average Emission of Air-polluting Gases in Urban Areas with High Traffic Density after Cold Starting" (European cycle). These results are collated in Table 1.

Table 1

| Running Time (minutes) | Temperature of reactor (° C) With mass produced ZV* | with ZV* according to the invention |
|---|---|---|
| 0 | 20 | 20 |
| 0.5 | 470 | 500 |
| 1.0 | 550 | 610 |
| 1.5 | 610 | 680 |
| 2.0 | 605 | 720 |
| 2.5 | 595 | 750 |
| 3.0 | 650 | 780 |
| 3.5 | 665 | 800 |
| 4.0 | 670 | 810 |
| Emissions | | |
| Carbon monoxide (g/test) | 34 | 10 |
| Unburnt hydrocarbons (g/test) | 1.6 | 0.6 |

*ZV = ignition adjustment device.

From the data in Table 1, the advantage of the invention becomes manifest. With the use of a device according to the invention, in only 1.5 minutes a temperature of 680° C was measured in the reactor. This temperature is regarded as approximately the lower limit of the optimum conversion temperature in thermal reactors. In the case of mass-produced ignition adjustment device, this temperature was not reached even after 4 minutes. In 4 minutes the reactor temperature had already risen to 810° C when employing a system according to the invention. At the same time, with the use of a system according to the invention, the carbon monoxide emission per test has been reduced by more than 70 percent and the emission of unburnt hydrocarbons by more than 62 percent.

EXAMPLE 2

Comparative tests were carried out with the same type of engine as in Example 1, and also equipped with a thermal reactor as described. In this example the test method employed was the CVS cycle (Constant Volume Sampling) described, for example, (1) in the Proceedings of the Air Pollution Control Annual Meeting, Cleveland, Ohio 1967 — paper by Broering, Werner and Rose; (2) The Federal Register 1970 35, 10 Nov., 219; (3) Institute of Mechanical Engineers — Proceedings of Conference on Air Pollution Control in Transport Engines — Solihull 1967, paper by Soltau and Larbey.

The results were as follows, all units being g/mile.

| Emissions | Hydrocarbons | CO | $NO_x$ |
|---|---|---|---|
| Without device of invention | 2 to 5 | 25 to 40 | 2.5 to 4.0 |
| With device | 0.3 | 2.0 | 1.4 |

-continued

| Emissions | Hydrocarbons | CO | $NO_x$ |
|---|---|---|---|
| of invention | | | |

It will be seen that a very substantial improvement was obtained; indeed the improvement easily meets even the most harsh legislation currently promulgated.

What I claim is:

1. A method of operating a spark ignition automotive engine provided with an exhaust gas reactor device, said engine having an intake manifold, a carburetor connecting with said manifold and a throttle valve in the carburetor, said method comprising retarding the ignition from normal spark timing of said engine during engine-part-load solely in response to the pressure upstream of the throttle valve; and, retarding the ignition from normal spark timing of said engine during engine-idling solely in response to the pressure downstream of the throttle valve, said retarding during engine-idling being greater than the retarding during engine-part-load.

2. A system for adjusting the ignition timing of a spark ignition automotive engine provided with an exhaust gas reactor device, said engine having an intake manifold, carburetor connecting with said manifold, and a throttle valve in the carburetor; which system comprises:

a. first ignition timing retarding means operatively responsive solely to the pressure downstream of said throttle valve during engine-idling so as to retard ignition from normal spark timing during said engine-idling; and, b. second ignition timing retarding means operatively responsive solely to the pressure upstream of the throttle valve during engine-part-load so as to retard ignition from normal spark timing during said engine-part-load, said first means operative so as to retard the ignition timing to a greater extent than said second means.

3. A system as claimed in claim 2 wherein the first and second ignition retarding means comprises a pressure transference member operatively connected at one end with a pressure responsive member and having at its other end a conduit to the downstream side of the throttle and a conduit to the upstream side of the throttle, and including switching means whereby said conduit to the downstream side of said throttle is in operative communication with said pressure responsive member during engine-idling and said conduit to said upstream side of said throttle valve is in operative communication with said pressure responsive member when the engine is under part load, and wherein said pressure responsive member is operatively connected to an ignition distributor on the engine, whereby said distributor is urged in a retard ignition timing direction during engine-idling and is also urged, to a lesser extent, in a retard ignition direction during engine-part-load.

4. A system as claimed in claim 3, wherein the pressure-responsive device is an elastically-deformable member located in a box to form a diaphragm separating two chambers in the box, and the said one end of the pressure-transference conduit communicates with one chamber only of the box.

5. A system as claimed in claim 2 wherein the said first and second ignition retarding means are operable by an electrical or mechanical switching device controllable by the position of the throttle valve and adapted to operate so as to actuate the first means while substantially simultaneously inactuating the second means, and vice versa.

* * * * *